US006474112B1

(12) United States Patent
Han et al.

(10) Patent No.: US 6,474,112 B1
(45) Date of Patent: Nov. 5, 2002

(54) DEVICE FOR ATTENUATING VIBRATION OF DRUM TYPE WASHING MACHINE AND METHOD FOR CONTROLLING WASHING

(75) Inventors: Dae Yeong Han, Seoul (KR); Kyung Seop Hong, Inchon (KR); Si Moon Jeon, Seoul (KR); Jae Won Chang, Kyonggi-do (KR)

(73) Assignee: LG Electronics Inc., Seoul (KR)

( * ) Notice: Subject to any disclaimer, the term of this patent is extended or adjusted under 35 U.S.C. 154(b) by 83 days.

(21) Appl. No.: 09/672,877

(22) Filed: Sep. 29, 2000

(30) Foreign Application Priority Data

Oct. 13, 1999 (KR) ..... 99-44382
Oct. 13, 1999 (KR) ..... 99-44383
Oct. 13, 1999 (KR) ..... 99-44384
Oct. 13, 1999 (KR) ..... 99-44387

(51) Int. Cl.[7] ..... D06F 37/22
(52) U.S. Cl. ..... 68/23.2
(58) Field of Search ..... 8/158, 159; 68/23.2, 68/12.06; 210/144; 74/573 F

(56) References Cited

U.S. PATENT DOCUMENTS 2,538,246 A * 1/1951 Holm-Hansen ..... 210/144
2,872,801 A * 2/1959 Smith ..... 68/23.2
2,886,979 A * 5/1959 Baxter ..... 68/23.2 X
3,060,713 A * 10/1962 Burkall ..... 68/23.2
3,066,522 A * 12/1962 Steinmuller ..... 68/23.2
3,135,688 A * 6/1964 Compans et al. ..... 210/144
3,235,082 A * 2/1966 Compans ..... 210/144 X
3,262,569 A * 7/1966 Wade et al. ..... 210/144

FOREIGN PATENT DOCUMENTS

EP 0326502 * 8/1989 ..... 68/23.2

* cited by examiner

*Primary Examiner*—Philip Coe
(74) *Attorney, Agent, or Firm*—Fleshner & Kim, LLP

(57) ABSTRACT

A device for attenuating vibration of a drum type washing machine is provided which includes a balance chamber provided in an outer tub for temporary storage of extracted water during spinning for serving as a weight for attenuating vibration of the outer tub, means for supplying the extracted water to the balance chamber during spinning, and means for draining the extracted water from the balance chamber to outside of the washing machine on completion of the spinning, thereby permitting a significant savings in component production cost, and a light weighted washing machine for convenient transportation of the washing machine.

25 Claims, 15 Drawing Sheets

DEVICE FOR ATTENUATING VIBRATION OF DRUM TYPE WASHING MACHINE AND METHOD FOR CONTROLLING WASHING

BACKGROUND OF THE INVENTION

1. Field of the Invention

The present invention relates to a drum type washing machine, and more particularly, to a device for attenuating vibration of a drum type washing machine.

2. Background of the Related Art

In general, the washing machine removes dirts and contaminants stuck on laundry by chemical decomposition and mechanical impact. Of washing machines, the drum type washing machine has an increasing demand because the drum type washing machine, not only permits to reduce a total height in comparison to a pulsator type washing machine in which an inner tub, a washing tub, is rotated in an upright position, but also permits to increase a washing capacity, and causes almost no problem of laundry entangling. A system of a related art drum washing machine will be explained with reference to FIGS. 1 and 2.

The related art drum washing machine is provided with a body 10, an outer tub 11 supported by dampers 41 and springs 40 in the body, and a cylindrical inner tub 12 rotatably mounted in the outer tub. The inner tub receives a driving force from a driving part for washing the laundry. The driving part has a pulley 33 around an inner tub shaft 34, a motor 30 mounted on one side of a lower part of the outer tub, and a belt 32 connected between the pulley and the motor for transmission of a power generated at the motor to the inner tub shaft. Though not shown, there is a driving part system in which a power generated by a rotor(not shown) and a stator(not shown) is transmitted to an inner tub shaft 34 directly, and other driving part system in which the power is transmitted to the inner tub shaft in a variety of methods.

The operation of the related art drum washing machine will be explained. Upon introducing the laundry into the inner tub 12 and starting washing, the washing proceeds from washing cycle→rinsing cycle→spinning cycle in succession until all the preset cycles are completed. That is, when the washing is started, a water supply device is put into operation, to supply washing water through a water passage 20, until the supplied water fills up to an appropriate level when the water supply is stopped and the driving part makes reverse and regular direction rotation, repeatedly. The reverse and regular direction rotation of the driving part is involved in speed reduction by speed reducing means, and applied to the inner tub 12. Then, the washing of the laundry is made both by impact caused by water circulation occurred as the inner tub is rotated in reverse and regular rotation directions and decomposition by detergent. Upon completion of the washing cycle, a rinsing cycle is carried out in the same process as the washing cycle, and upon completion of the rinsing cycle, the process proceeds to the spinning cycle right away. Upon starting the spinning cycle, the water filled in the inner tub 12 is drained completely through a drain hose 54 by a drain pump 31. In this instance, as the driving power of the driving part is transmitted to the inner tub 12 as it is without speed reduction, a centrifugal force caused by high speed rotation of the inner tub 12 extracts water contained in the laundry, to dehydrate the laundry. However, the drum washing machine, a horizontal type of washing machine, is very sensitive to vibration compared to the pulsator type washing machine, an upright type of washing machine, in the spinning cycle, because the drum washing machine, a horizontal type washing machine, having the inner tub 12 disposed in a horizontal position, and the drain pump 31 and the motor 30 mounted on a rear surface of the outer tub, to make a front portion of the outer tub relatively less heavy, may cause heavy vibration. And, the outer tub 11 disposed in a front portion of the body receives a vibration of the inner tub caused by eccentricity of an inner tub rotation coming from unbalanced settling of the laundry in the inner tub 12 during spinning 12 directly, to draw a large ellipse as the outer tub 11 rotates. That is, if a vibration is occurred when the inner tub 12 carries out the washing and the spinning as the inner tub 12 rotates, and the vibration is transmitted to the outer tub 11 directly without attenuation, there is cases when the vibration is matched with a natural vibration of the outer tub, to cause a resonance. Eventually, as shown in FIGS. 2A and 2B, the following vibration attenuator is used for reducing such a vibration.

The first vibration attenuator has pairs of dampers 41 each pair on left and right sides of the body 10 connected between lower portions of an outer circumference of the outer tub 1 1 and lower portions of the body 10, for attenuating vertical vibration among vibrations occurred at the inner tub 2 rotates.

The second vibration attenuator has a plurality of holding springs 40 connected between an upper portion of the outer circumference of the outer tub 11 and an upper surface of the body 10, for restoring displacement absorbed by the damper 41 caused by the vibration coming from rotation of the inner tub 12.

The third vibration attenuator has weights for increasing weight of the outer tub 11 to reduce a natural frequency of the outer tub itself, to match the natural frequency of the outer tub 11 with a frequency occurred at the inner tub 12 at an initial stage of the spinning cycle when the rotation speed is low. Accordingly, at starting of rotation of the inner tub 12 in the spinning, the frequencies are the same already, and there is no chance when the natural frequency of the outer tub 11 becomes the same with the frequency of the inner tub 12 during the spinning, to prevent the resonance in advance. That is, weights 42 of cast iron or concrete are provided to an upper surface and a lower surface of the outer tub, not only for increasing the weight of the outer tub 11, but also balancing weight of the motor 30 and drain pump 31 mounted on the outer tub.

However, the third attenuator has the following problems.

The cast iron or concrete used for attenuation of the vibration increases a production cost, as well as weight which causes a problem in transportation of the drum type washing machine.

And, reinforcement design for other related components for the increased weight causes an increase of the production cost.

SUMMARY OF THE INVENTION

Accordingly, the present invention is directed to a device for attenuating vibration of a drum type washing machine that substantially obviates one or more of the problems due to limitations and disadvantages of the related art.

An object of the present invention is to provide a device for attenuating vibration of a drum type washing machine, which can reduce a transportation weight of the drum type washing machine and save a production cost.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the device for attenuating vibration of a drum type washing machine includes a balance chamber provided to an outer tub for temporary storage of extracted water in spinning for serving as a weight for attenuating vibration of the outer tub, means for supplying the extracted water to the balance chamber in the spinning, and means for draining the extracted water from the balance chamber to outside of the washing machine on completion of the spinning.

The means for supplying the extracted water includes an extracted water flow passage for supplying water in the outer tub to the balance chamber on the same time with draining to outside of the washing machine, and an extracted water pump connected to the extracted water flow passage for pumping the extracted water for smooth drainage of the water.

The means for draining the extracted water includes a drain water flow passage for draining the water from the outer tub and the balance chamber to outside of the washing machine, and a drain water pump connected to the drain water flow passage for pumping the water for smooth drainage of the water.

In another aspect of the present invention, there is provided a method for controlling washing of a drum type washing machine comprising the steps of washing, rinsing, and spinning in succession, wherein the step of spinning includes the step of supplying water to a balance chamber.

The method for controlling washing of a drum type washing machine further includes a step of draining water remained in the washing machine after the step of spinning.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Reference will now be made in detail to the preferred embodiments of the present invention, examples of which are illustrated in the accompanying drawings. Components identical to the related art will be given the same reference symbols, and explanations of which will be omitted in explanation of the present invention.

Figure 1:
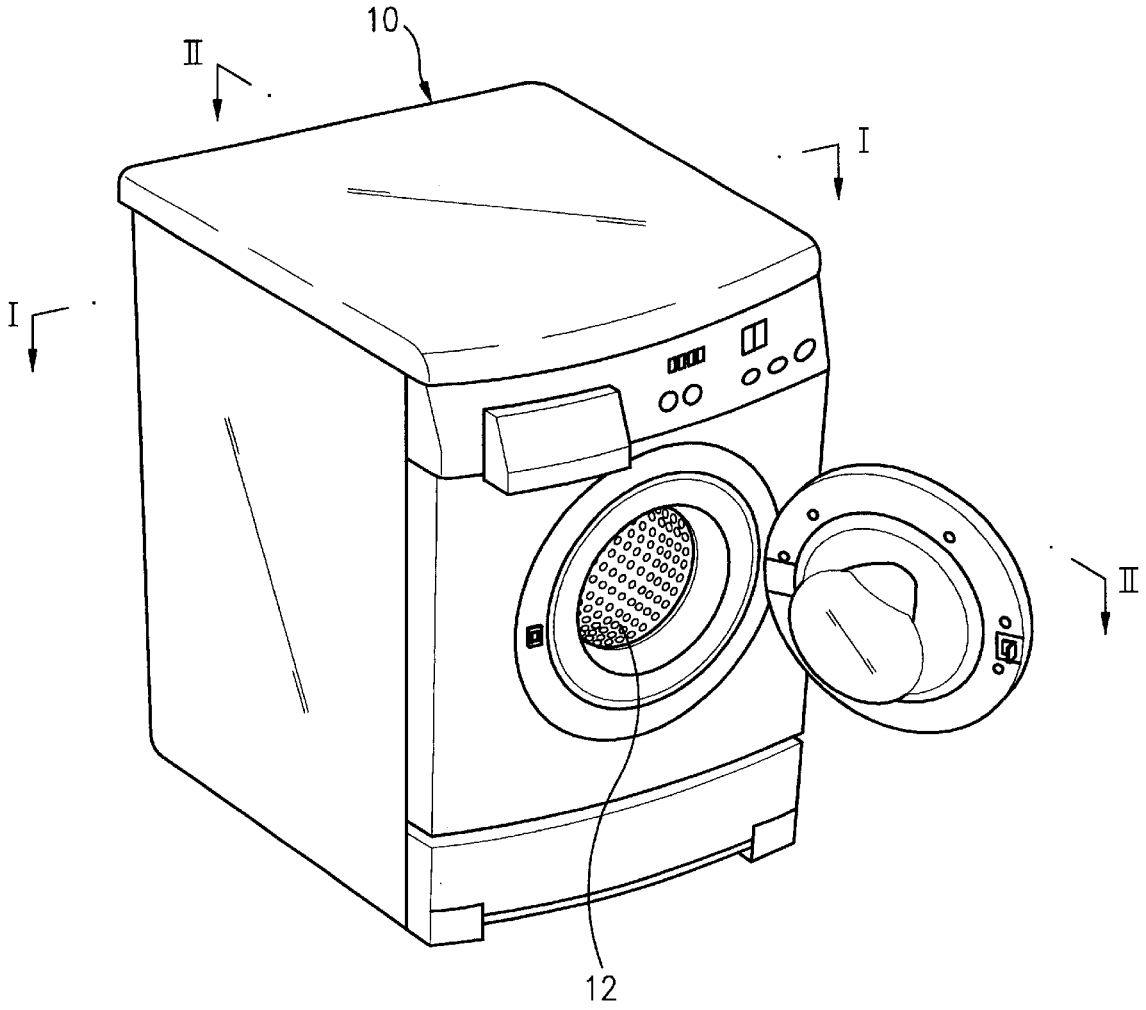
FIG. 1 Prior Art
FIG. 1 illustrates a perspective view showing a system of a related art drum type washing machine.
Figure 2A:
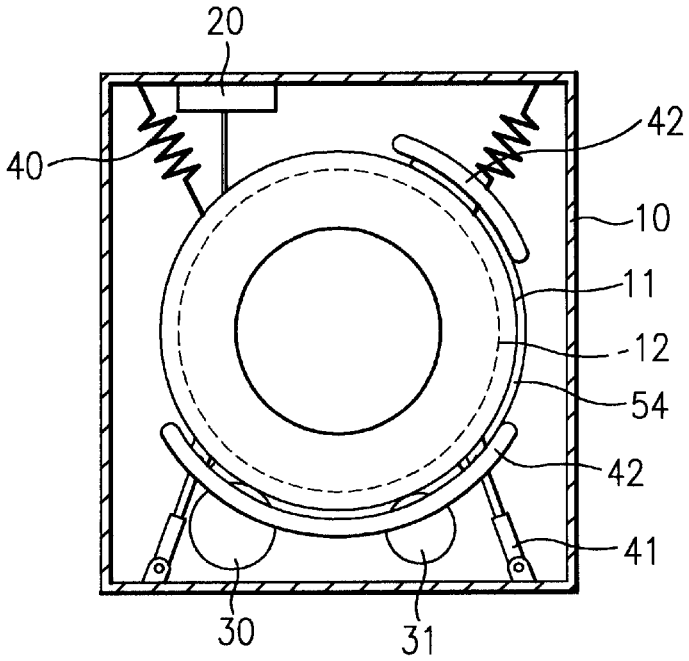
FIG. 2A Prior Art
FIG. 2A illustrates a section across line I—I in FIG. 1 showing an attenuator in a related art drum type washing machine, schematically.
Figure 2B:
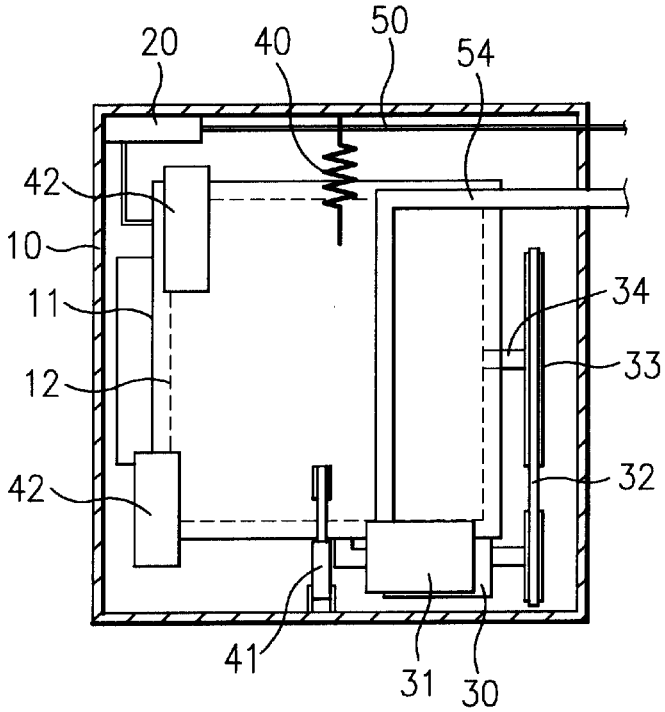
FIG. 2B Prior Art
FIG. 2B illustrates a section across line II—II in FIG. 1 showing an attenuator in a related art drum type washing machine, schematically.
Figure 3:
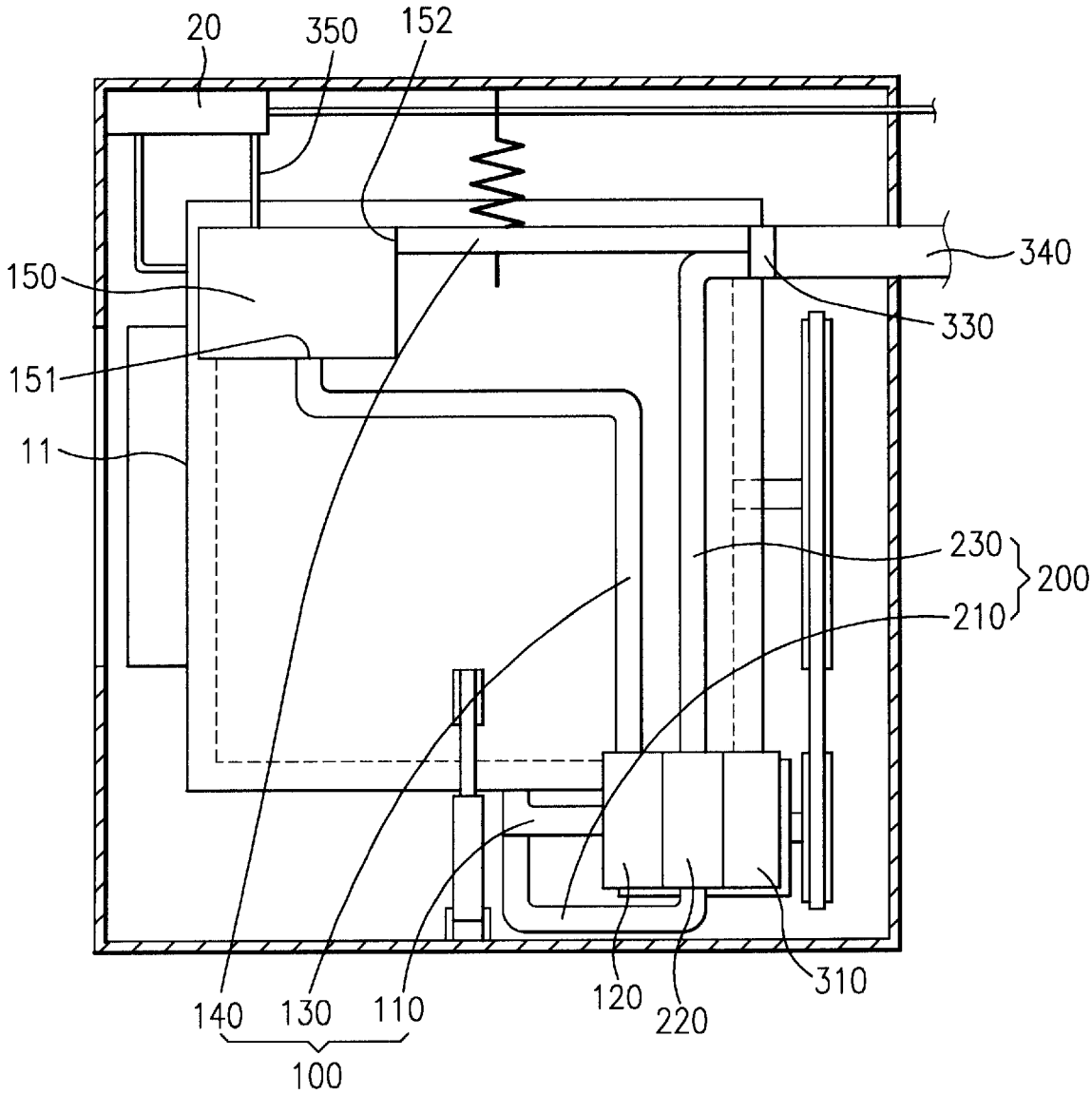
FIG. 3 illustrates a system of a device for attenuating vibration in accordance with a first preferred embodiment of the present invention.

Referring to FIG. 3, a device for attenuating vibration in accordance with a first preferred embodiment of the present invention, a first form of the present invention, includes a balance chamber, supply means, and drain means. The balance chamber is provided to an outer tub for temporary storage of extracted water in the spinning for suppressing vibration of the outer tub. The supply means is provided to an outside of the outer tub for supplying extracted water to the balance chamber in spinning. And, the drain means is provided to an outside of the outer tub for draining the water in the balance chamber to outside of the washing machine in draining. The supply means has an extracted water flow passage and an extracted water pump. The extracted water flow passage is provided on outside of the outer tub for supplying the water in the outer tub to the balance chamber and, on the same time, to drain outside of the washing machine. And, the extracted water pump is provided to the extracted water flow passage for smooth flow of water on the extracted water flow passage. The extracted water flow passage 100 has a reception tube 110, a supply tube 130 and a discharge tube 140. The reception tube 110 has one end connected to a bottom of the outer tub and the other end connected to the extracted water pump for flowing of water from the outer tub 11 to the extracted water pump 120. The supply tube 130 has one end connected to the extracted water pump and the other end connected to a bottom of the balance chamber for supplying water from the extracted water pump 120 to the balance chamber 150. And, the discharge tube 140 has one end connected to a top of the balance chamber and the other end exposed to outside of the washing machine for discharging surplus water after the water fills the balance chamber 150 to outside of the washing machine.

In the meantime, the drain means has a drain water flow passage, and a drain water pump.

The drain water flow passage is provided to outside of the outer tub for draining the water in the outer tub and the balance chamber to outside of the washing machine. And, the drain water pump is provided to the drain water flow passage for smooth flow of the water in the drain water flow passage. The drain water flow passage 200 has a first drain tube 210 and a second drain tube 230. In this instance, the first drain tube 210 has one end connected to a portion of the reception tube 110 and the other end connected to the drain water pump. And, the second drain tube 230 has one end connected to a drain pump and the other end exposed to outside of the washing machine for discharging the water in the drain water pump 220 to outside of the washing machine.

The operation of the device for attenuating vibration in accordance with the first preferred embodiment of the present invention will be explained in detail in the cases of spinning and draining, separately.

Figure 4A:
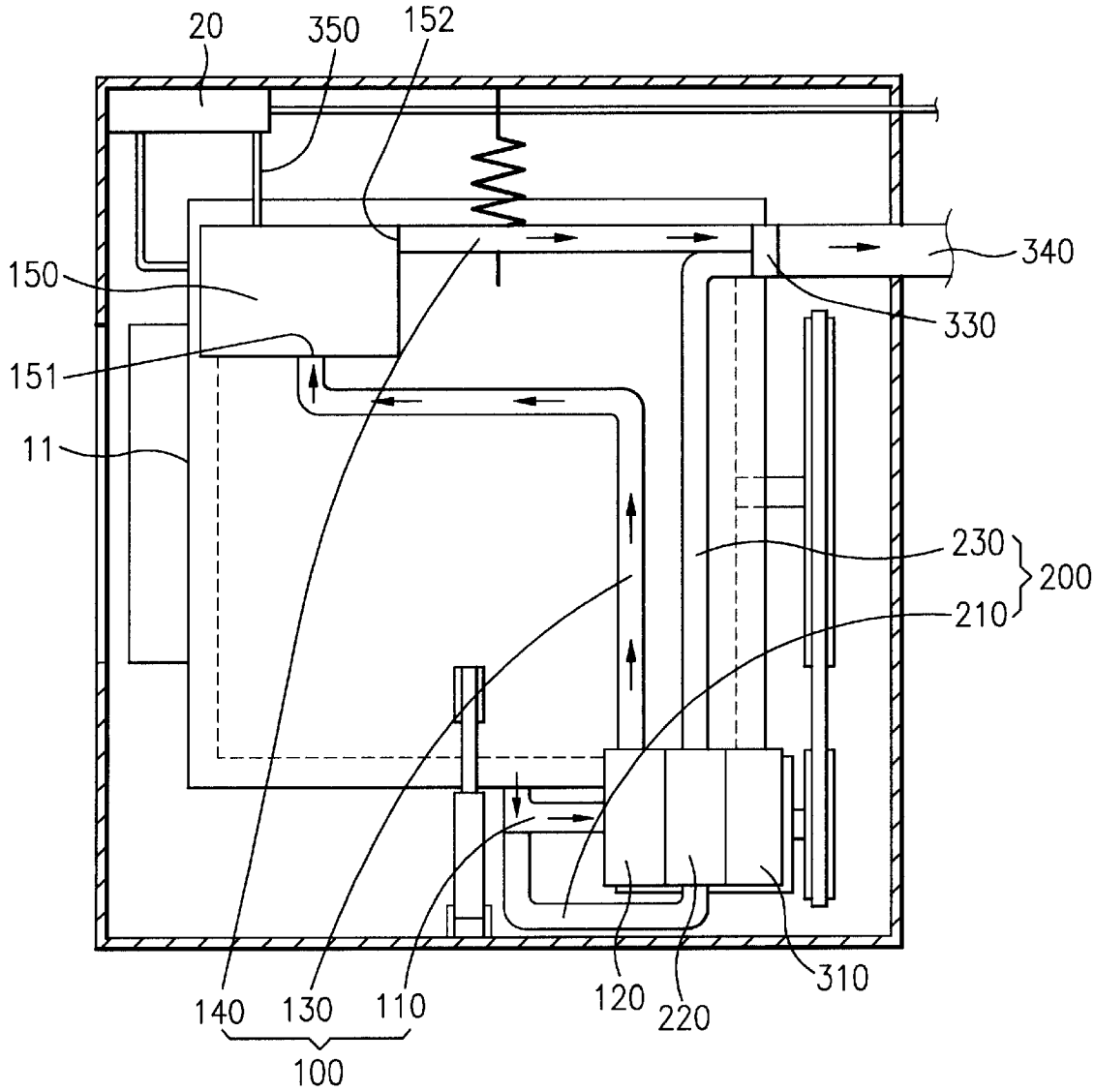
FIG. 4A illustrates water flow in spinning in a device for attenuating vibration in accordance with a first preferred embodiment of the present invention, schematically.

First, referring to FIG. 4A, the water accumulated in the outer tub 11 in spinning flows into the extracted water pump 120 through the reception tube 110 by a rotation force of the extracted water pump 120, and discharged to the balance chamber 150 through the supply tube 130 via an inlet 151 to the balance chamber. Surplus water after the balance chamber is filled fully is discharged to outside of the washing machine through the discharge tube 140. The water in the balance chamber 150 serves as the weight, a vibration attenuator in the related art, during spinning for attenuating the vibration.

Figure 4B:
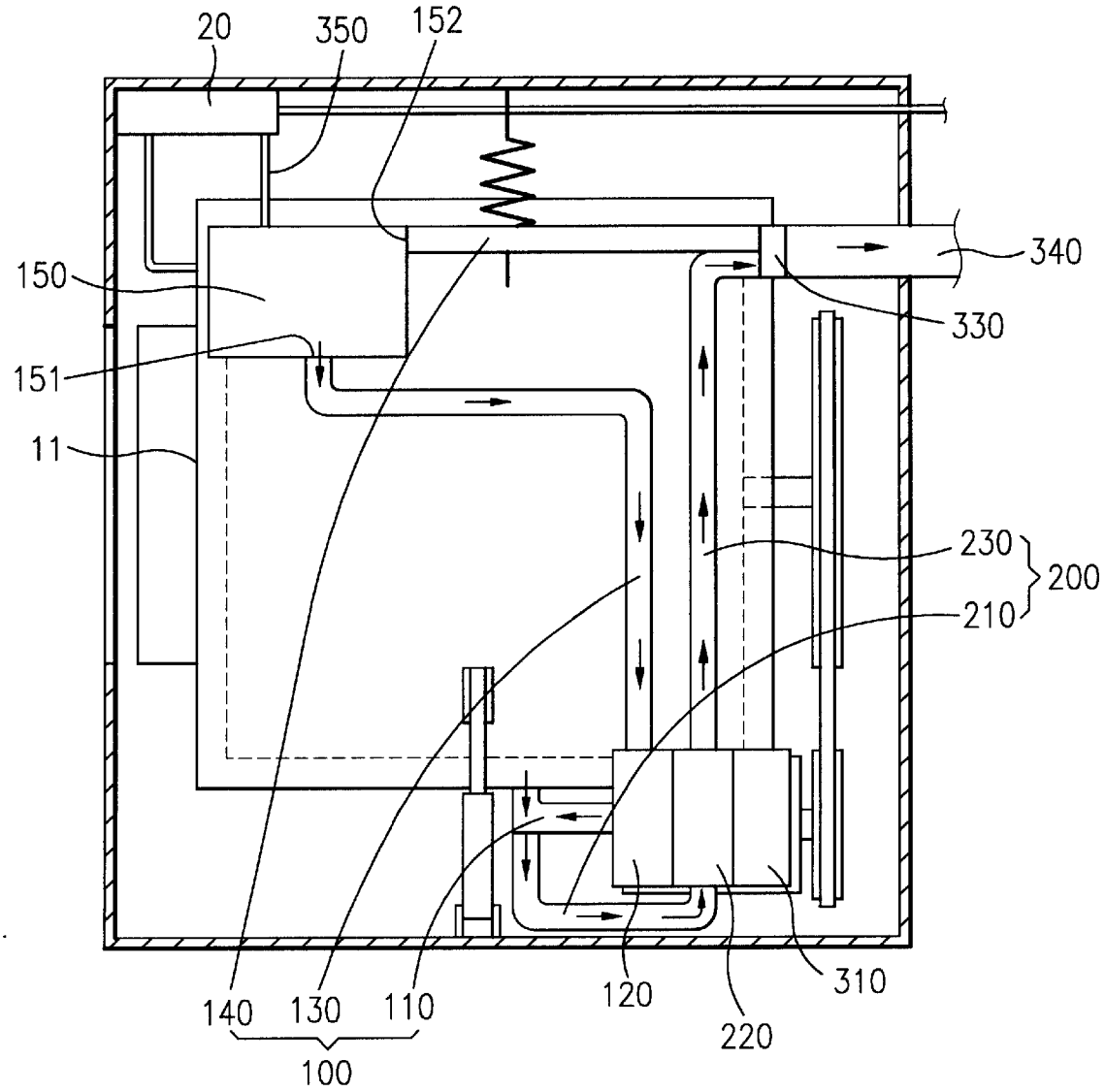
FIG. 4B illustrates water flow in draining in a device for attenuating vibration in accordance with a first preferred embodiment of the present invention, schematically.

Second, referring to FIG. 4B, the water stored in the balance chamber 150 flows to the first drain tube 210 through the supply tube 130 and the reception tube 110 by gravity, and the water accumulated in, and to a level of the outer tub 11 flows to the drain water pump by a rotating force of the drain water pump 220 through the first drain tube 210, and is discharged completely to outside of the washing machine through the second drain tube 230. At the end, when draining of the water is completed, all operation of the device for attenuating vibration ends.

In the meantime, as shown in FIGS. 3~7B, in order for the device for attenuating vibration in accordance with a first preferred embodiment of the present invention to be more desirable, it is preferable that the device for attenuating vibration has a communication tube 350, a discharge hose 340, a supplementary check valve 330 and a blocking wall 312 additionally, together with integrated extracted water pump 120 and drain water pump 220. The foregoing will be explained in more detail.

First, as shown in FIGS. 3~4B, the communication tube 350 has one end connected to a top of the balance chamber 150, and the other end connected to a water passage 20 through which the washing water is supplied in washing, for communication to the balance chamber for smooth water flow to/from the balance chamber 150 in draining and supplying water from/to the balance chamber 150.

Figure 5A:
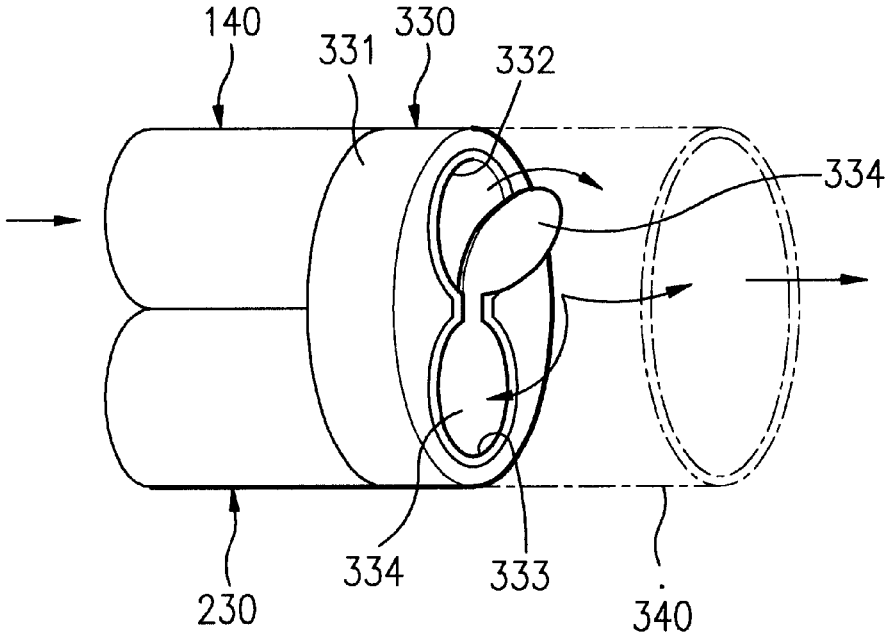
FIG. 5A illustrates a perspective view of a key part showing an operation state of one embodiment supplementary check valve in spinning in a device for attenuating vibration of the present invention.
Figure 5B:
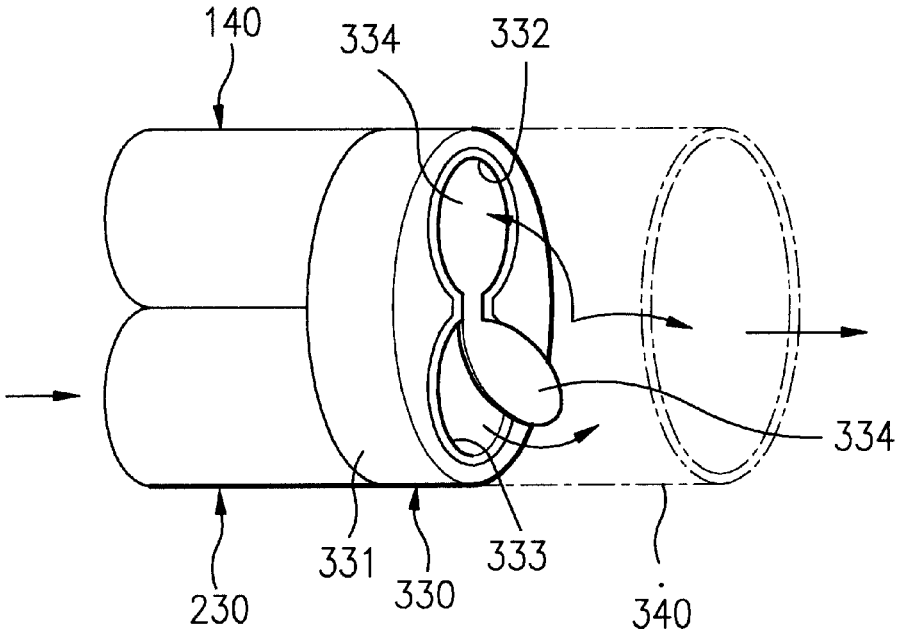
FIG. 5B illustrates a perspective view of a key part showing an operation state of a supplementary check valve in draining in a device for attenuating vibration of the present invention.

Second, as shown in FIGS. 5A and 5B, the discharge hose 340 has one end connected both to an outer end of the discharge tube 140 and an outer end of the second drain tube 230, and the other end exposed to outside of the washing machine, for guiding the water from the discharge tube 140 and the second drain tube 230 into one flow passage to outside of the washing machine, which makes an outer appearance of the washing machine simple. However, it is preferable that the supplementary check valve is provided additionally at a connection of the discharge hose, the discharge tube and the second drain tube for preventing a reverse flow of the water in the discharge hose 340 to the discharge tube 140 or the second drain tube 230. That is, the supplementary check valve 330 has a connector 331 for connecting the outer ends of the discharge tube 140 and the second drain tube 230 to the discharge hose 340, a first hole 332 in communication with the discharge tube, a second hole 333 in communication with the second drain tube, and a dumbbell form of plug 334 fitted to the connector 331 such that the plug can be swung, for opening the first hole 332 only in spinning, and opening the second hole 333 only in draining by a pressure difference between the discharge tube 140 and the second drain tube 230.

The supplementary check valve 330 has the following operation and service.

Referring to FIG. 5A, because a pressure in the discharge tube 140 is higher than a pressure in the discharge hose 340 by the rotation force of the extracted water pump 120 in spinning, the plug on the first hole 332 is opened, to permit water to flow through the first hole, while the plug on the second hole 333 is kept closed due to the water pressure flowing through the first hole 332. And, as shown in FIG. 5B, because a pressure in the second drain tube 230 is higher than a pressure in the discharge hose 340 by the rotation force of the drain water pump 220 in draining, the plug on the second hole 333 is opened, to permit water to flow through the second hole, while the plug on the first hole 332 is kept closed due to the water pressure flowing through the second hole 333.

Figure 6:
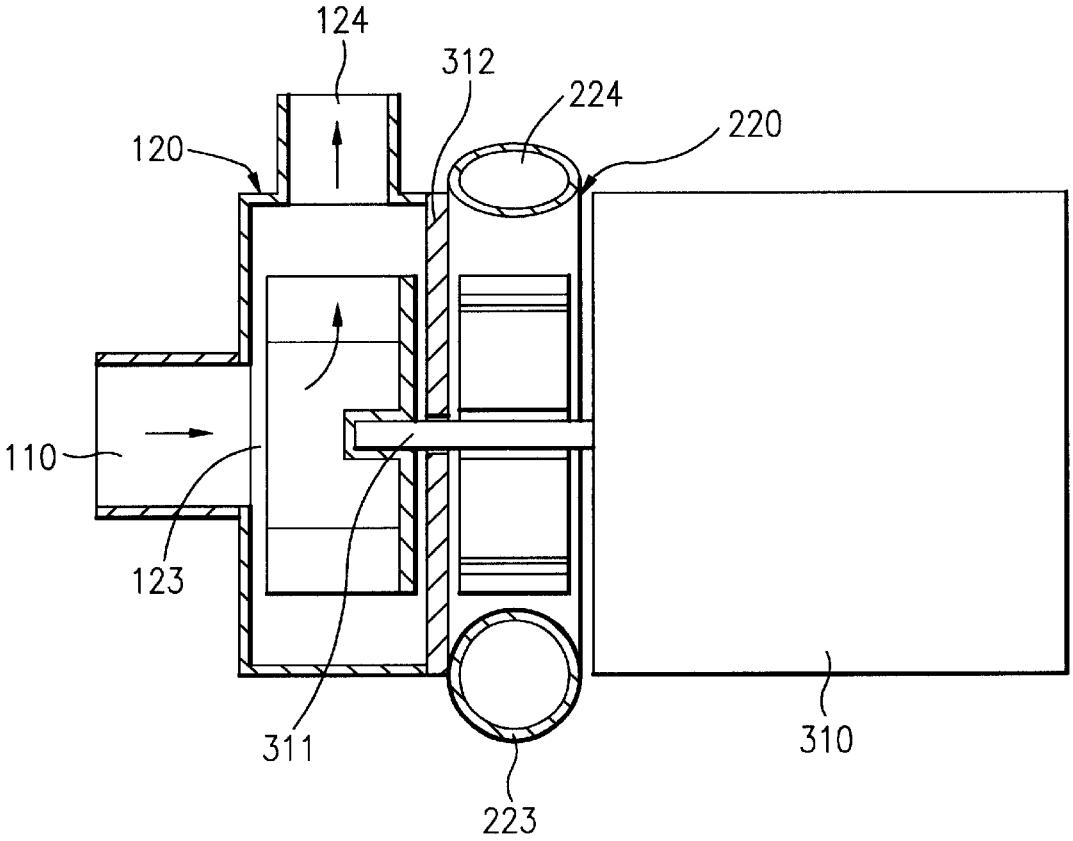
FIG. 6 illustrates a section showing a state an extracted water pump and a drain pump have an integrated form in a device for attenuating vibration of the present invention.

Third, as shown in FIG. 6, it is preferable that the device for attenuating vibration has one pump motor shaft 311 having both the extracted water pump 120 and the drain pump 220 connected thereto, for saving a production cost as the extracted water pump 120 and the drain pump 220 are driven alternatively according to a direction of rotation of the pump motor 310.

Fourth, as shown in FIG. 6, it is preferable that the blocking wall 312 is provided between the extracted water pump 120 and the drain water pump 220, for blocking water flow through a boundary of the extracted water pump 120 and the drain water pump 220 as the extracted water pump 120 and the drain water pump 220 are operative alternatively.

Figure 7A:
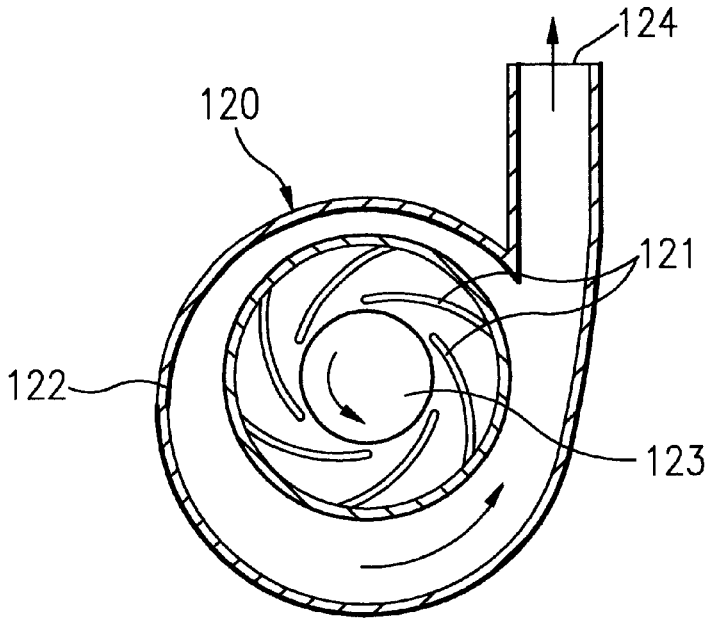
FIG. 7A illustrates a section showing a structure of an extracted water pump and water flow in spinning in a device for attenuating vibration of the present invention.
Figure 7B:
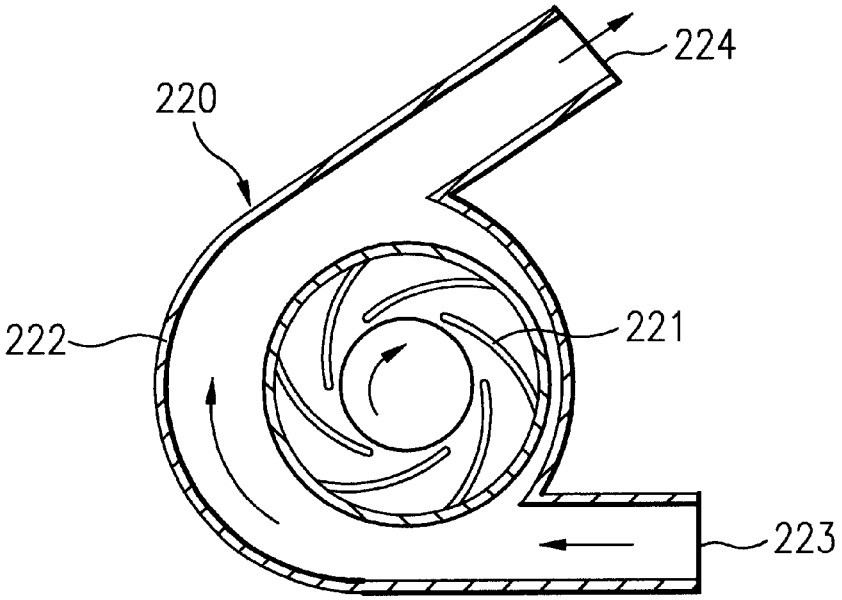
FIG. 7B illustrates a section showing a structure of a drain pump and water flow in draining in a device for attenuating vibration of the present invention.

Referring to FIGS. 7A and 7B, the extracted water pump 120 and the drain water pump 220 on one pump motor shaft will be explained, additionally. As shown in FIG. 7A, the extracted water pump 120 has an impeller 121 for drawing and discharging water, a casing 122 for guiding water drawn into the pump by the impeller 121, an inlet 123 at a center of the casing 122 for connecting to the reception tube 110 and an outlet 124 formed along a circumference of the casing for connection to the supply tube 130. The extracted water pump 120 operative only in spinning has the following operation principle. When the impeller 121 is rotated by a regular direction rotation force of the pump motor 310, the water in the outer tub 11 is drawn into the casing 122 through the reception tube 110, and discharged to the supply tube 130 through the outlet 124. And, as shown in FIG. 7B, the drain water pump 220 has an impeller 221 rotatably fixed for drawing and discharging water, a casing 222 for guiding water drawn into the pump by the impeller, an inlet 223 formed along a circumference of the casing 122 for connecting to the first drain tube 210, and an outlet 224 formed along the circumference of the casing for connection to the second drain tube 230. The drain water pump 220 operative only in draining has the following operation principle. When the impeller 221 is rotated by a reverse direction rotation force of the pump motor 310, the water in the outer tub 11 is drawn into the casing 222 through the reception tube 110 and the drain tube 210. And, the water in the balance chamber 150 is drawn into the casing through the supply tube 130, the reception tube, and the first drain tube 210. The water drawn into the casing is discharged to the second drain tube 230 through the outlet 234 by the rotating force of the impeller.

Figure 8:
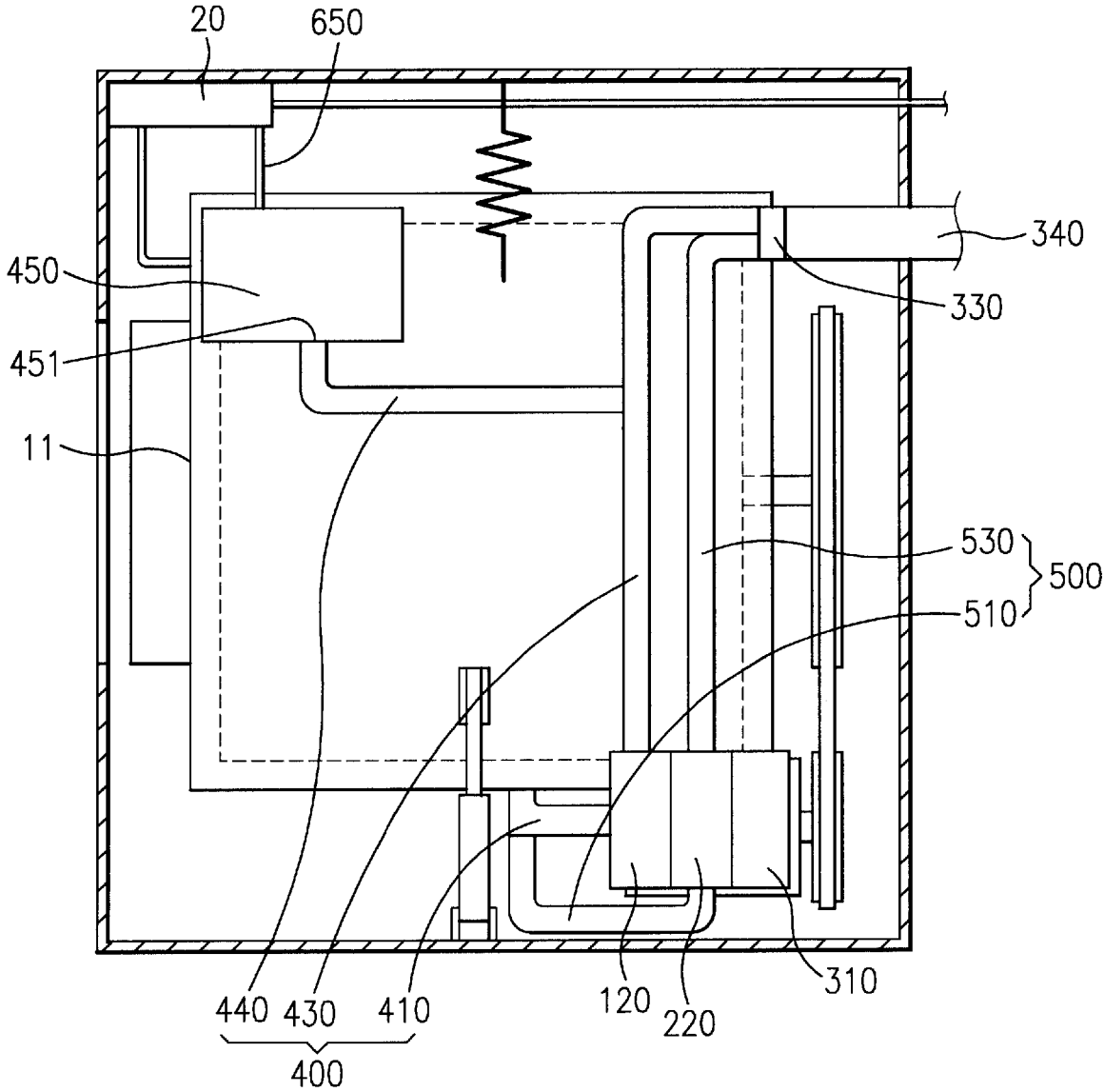
FIG. 8 illustrates a system of a device for attenuating vibration in accordance with a second preferred embodiment of the present invention.

In the meantime, as shown in FIG. 8, a device for attenuating vibration in a second preferred embodiment of the present invention, a first form of the present invention, has the following system. Before starting explanation on the system, components identical to the first embodiment device for attenuating vibration will be given the same names and reference symbols, and explanations of which will be omitted.

The device for attenuating vibration in a second preferred embodiment of the present invention includes a balance chamber 450, an extracted water flow passage 400, an extracted water pump 120, a drain water flow passage 500, and a drain water pump 220. The extracted water flow passage 400 has a reception tube 410, a discharge tube 430, a supply tube 440, and communication tubes 650. The reception tube 410 has one end connected to a bottom of the outer tub 11 and the other end connected to the extracted water pump for flowing of the water in the outer tub 11 to the extracted water pump 120. The discharge tube 430 has one end connected to the extracted water pump and the other end exposed to outside of the washing machine for discharging the water flowed into the extracted water pump 120 to outside of the washing machine. The supply tube 440 has one end connected to a bottom of the balance chamber and the other end connected to one portion of the discharge tube 430 lower than a bottom of the balance chamber for supplying a portion of the water discharged from the extracted water pump 120 to the balance chamber 450. The communication tube 650 has one end connected to a top of the balance chamber and the other end connected to the water passage 20 for communication of air to the balance chamber. The drain water flow passage 500 has a first drain tube 510 and a second drain tube 530. The first drain tube 510 has one end connected to one portion of the reception tube 410 and the other end connected to the drain water pump for water flow from the outer tub 11 and the balance chamber 450 to the drain water pump 220. The second drain tube 530 has one end connected to the drain water pump and the other end exposed to outside of the washing machine for discharging the water from the drain water pump 220 to outside of the washing machine.

The operation of the device for attenuating vibration in accordance with the second preferred embodiment of the present invention will be explained in detail for the cases of spinning and draining, separately.

Figure 9A:
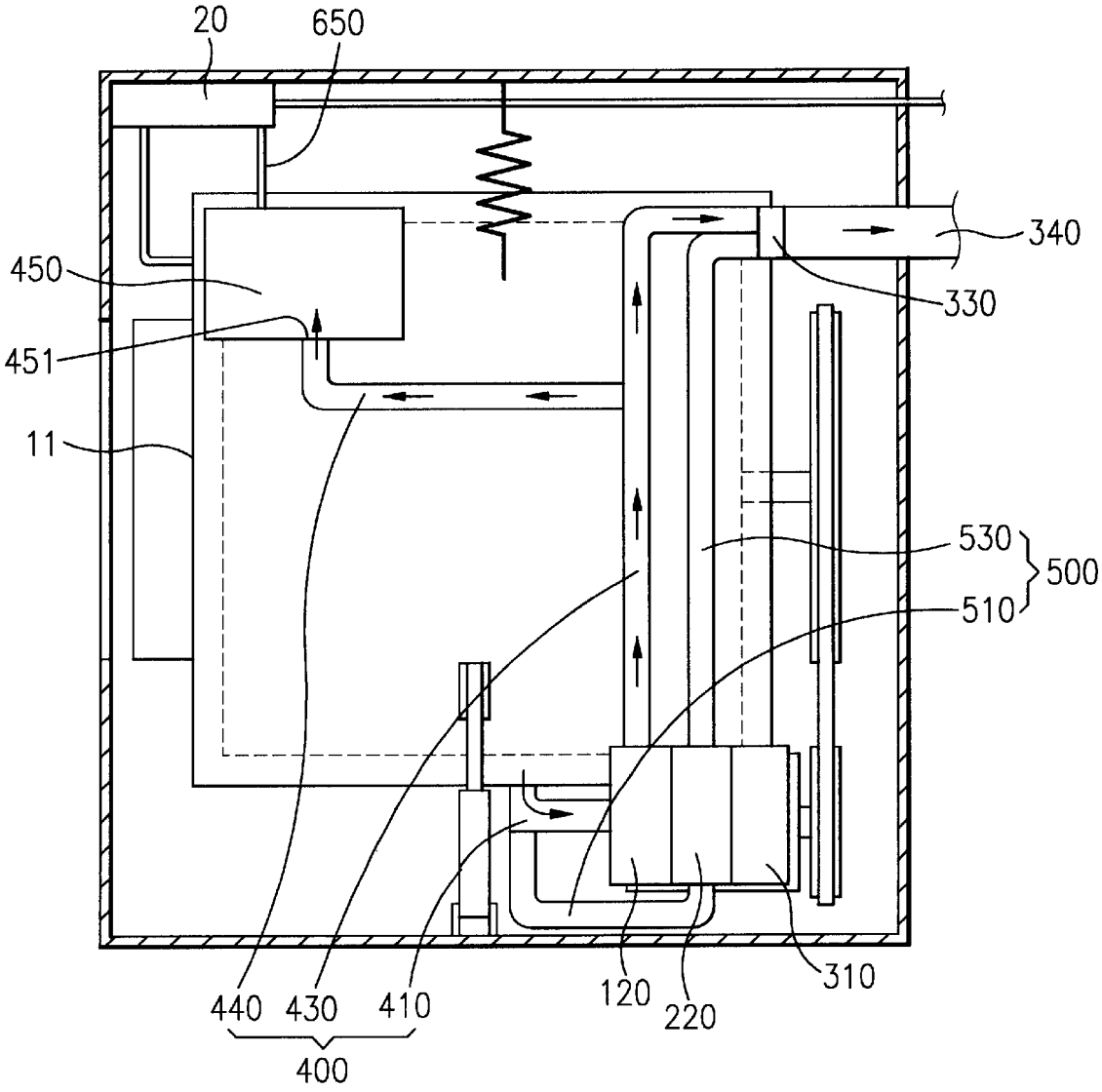
FIG. 9A illustrates water flow in spinning in a device for attenuating vibration in accordance with a second preferred embodiment of the present invention, schematically.

First, referring to FIG. 9A, the water accumulated in the outer tub 11 in spinning flows into the extracted water pump through the reception tube 410 by a rotation force of the extracted water pump 120, and discharged through the discharge tube 430. A portion of the water discharge through the discharge tube 430 is discharged to outside of the washing machine, and the other portion of the water flows into the balance chamber 450 to fill the balance chamber 450 fully through the supply tube 440, and the inlet 451 to the balance chamber. The water filled in the balance chamber 450 serves as the weight, a vibration attenuator in the related art, during spinning for attenuating the vibration.

Figure 9B:
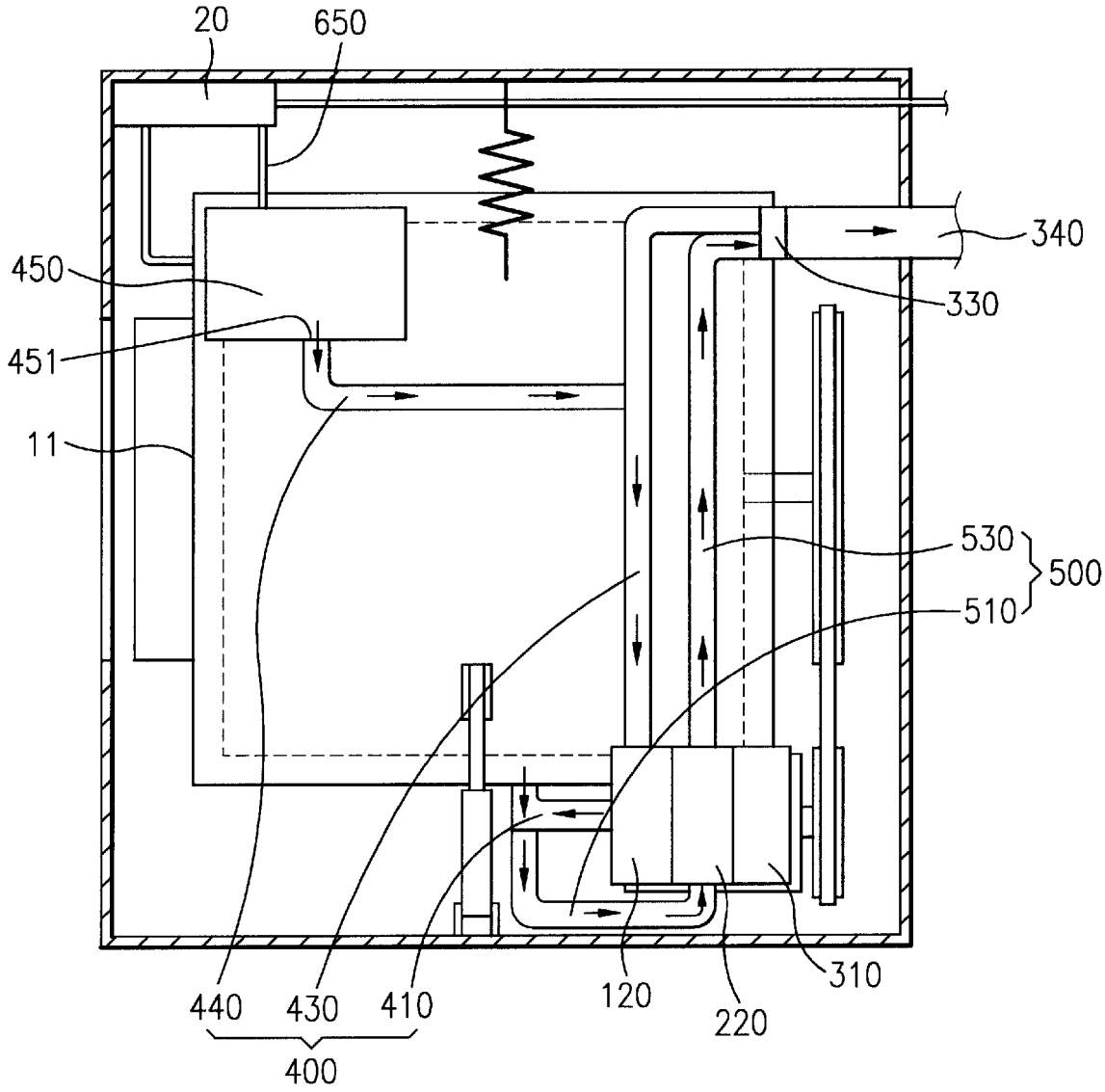
FIG. 9B illustrates water flow in draining in a device for attenuating vibration in accordance with a second preferred embodiment of the present invention, schematically.

Second, referring to FIG. 9B, the water stored in the balance chamber 450 flows to the first drain tube 510 through the supply tube 130, the discharge tube 430, and the reception tube 410 by gravity, and the water accumulated in, and to a level of the outer tub 11 also flows to the first drain tube. The water in the first drain tube 510 is discharged to outside of the washing machine through the second drain tube 530 by a rotating force of the drain water pump 220, completely. In the water supply to the balance chamber 450 during spinning, or in the water discharge from the balance chamber 450 during draining in above operation by the rotation force either of the extracted water pump 120 and the drain water pump 220, the free flow of air through the communication tube 650 allows a smooth flow of water to/from the balance chamber, thereby preventing formation of vacuum in the balance chamber.

In the meantime, as shown in FIGS. 8~9B, in order for the device for attenuating vibration in accordance with a second preferred embodiment of the present invention to be more desirable, it is preferable that the device for attenuating vibration has the additional components provided in the first embodiment, additionally.

First, there is a discharge hose 340 having one end connected both to an outer end of the discharge tube 430 and an outer end of the second drain tube 530, and the other end exposed to outside of the washing machine. Together with this, there is a supplementary check valve 330 provided at a connection of the discharge hose 340, the discharge tube 430 and the second drain tube 530.

Second, the second embodiment device for attenuating vibration has one pump motor shaft (see 312 in FIG. 6) having both the extracted water pump 120 and the drain pump 220 connected thereto.

Third, the second embodiment device for attenuating vibration has a blocking wall(see 312 in FIG. 6), additionally.

Detailed explanations on structures, services, and operations of the additional components will be omitted as they are explained in the first embodiment device for attenuating vibration.

In the meantime, as shown in FIG. 9, a device for attenuating vibration in accordance with a third preferred embodiment of the present invention, a first form of the present invention, has the following system. Before starting explanation on the system, components identical to the first embodiment will be given the same names and reference symbols, and explanations of which will be omitted.

The device for attenuating vibration in a third preferred embodiment of the present invention includes a balance chamber 750, an extracted water flow passage 700, an extracted water pump 120, a drain water flow passage 800, and a drain water pump 220. The extracted water flow passage 700 has a reception tube 710, a discharge tube 730, and a supply tube 740. The reception tube 710 has one end connected to a bottom of the outer tub 11 and the other end connected to the extracted water pump for flowing of the water in the outer tub 11 to the extracted water pump 120. The discharge tube 730 has one end connected to the extracted water pump and the other end exposed to outside of the washing machine for discharging the water flowed into the extracted water pump 120 to outside of the washing machine. The supply tube 740 has one end connected to the discharge tube 730 and the other end connected to a top of the balance chamber for supplying a portion of the water discharged from the extracted water pump 120 to the balance chamber 750. The drain water flow passage 800 has a first drain tube 810, a supplementary tube 830, a second drain tube 840, and a check valve 920. The first drain tube 810 has one end connected to one portion of the reception tube 710 and the other end connected to the drain water pump for water flow from the outer tub 11 to the drain water pump 220. The supplementary tube 830 has one end connected to a bottom of the balance chamber 750 and the other end connected to the first drain tube 810 for water flow from the balance chamber 750 to the drain water pump 220. The second drain tube 840 has one end connected to the drain water pump and the other end exposed to outside of the washing machine for discharging the water from the drain water pump 220 to outside of the washing machine. The check valve is fitted to a connection part of the reception tube and the first drain tube for being closed/opened by a pressure difference between the reception tube 710 and the first drain tube 810. As shown in FIG. 11B, one embodiment of the check valve 920 has a connection tube 921 connected between the reception tube 710 and the first drain tube, a small hole 922 in the connection tube formed by projection from an inside wall of the connection tube having a diameter smaller than a diameter of the connection tube centered on an axis of the connection tube, a ball 923 for opening/closing the hole 922 by a pressure difference between the reception tube 710 and the first drain tube 810 to serve as a valve, and a support plate 924 in the connection tube having a plurality of holes for supporting the ball during draining and allowing the water to pass.

The operation of the device for attenuating vibration in accordance with the third preferred embodiment of the present invention will be explained in detail for the cases of spinning and draining, separately.

Figure 11A:
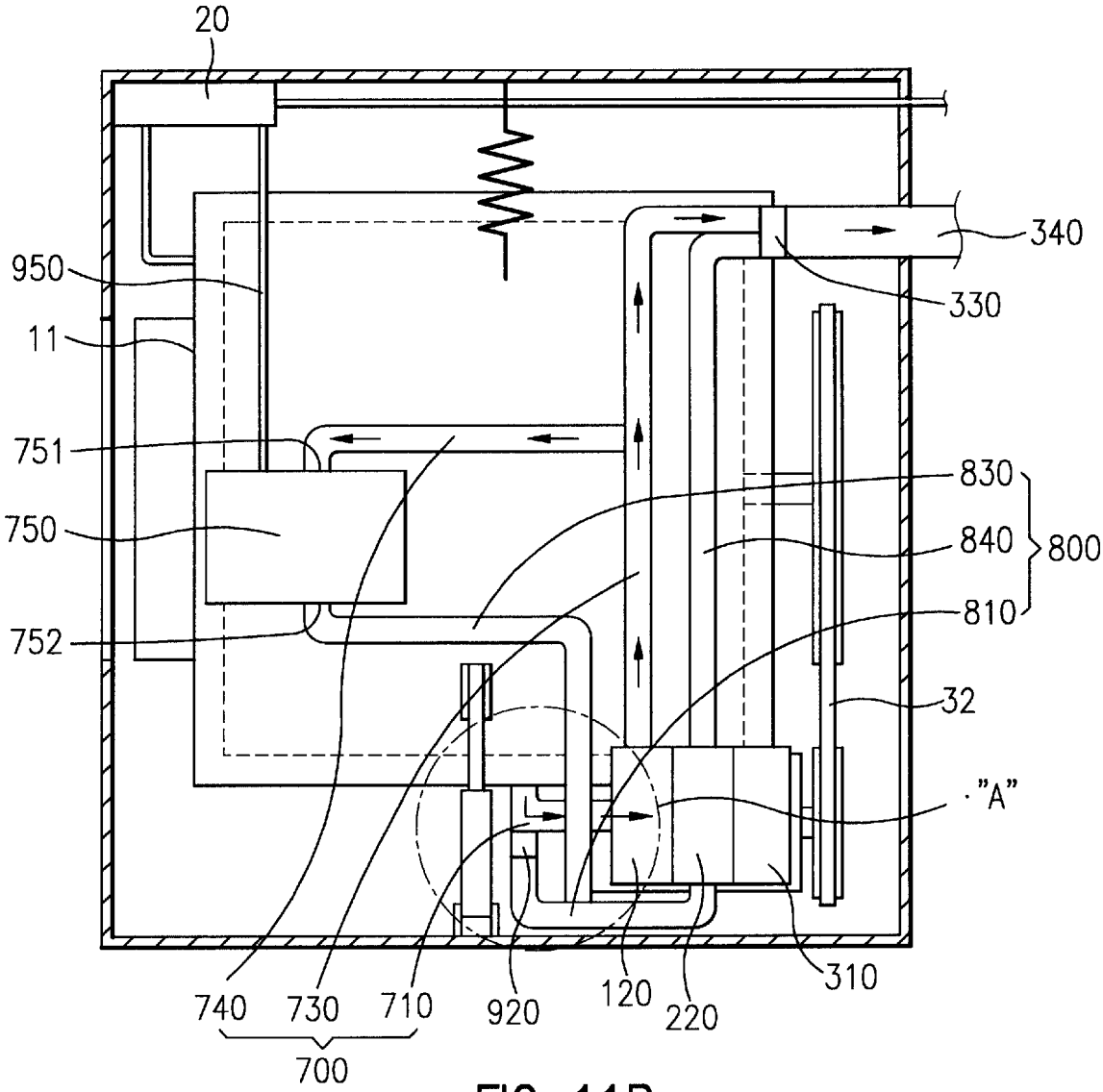
FIG. 11A illustrates water flow in spinning in a device for attenuating vibration in accordance with a third preferred embodiment of the present invention, schematically.
Figure 11B:
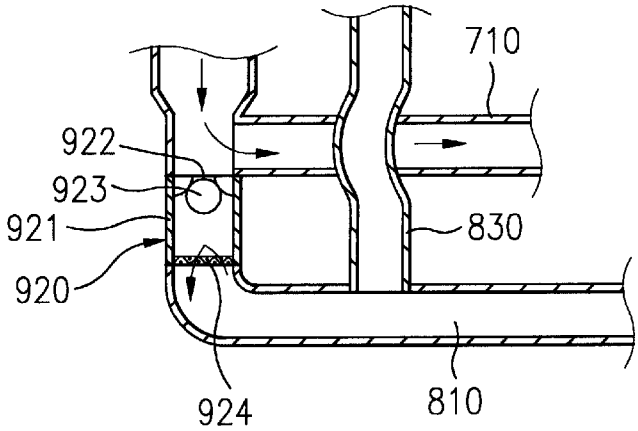
FIG. 11B illustrates a section of "A" part in FIG. 11A showing an operation state of one embodiment check valve in spinning in a device for attenuating vibration in accordance with a third preferred embodiment of the present invention.

First, referring to FIGS. 11A and 11B, the water accumulated in the outer tub 11 in spinning flows into the extracted water pump through the reception tube 710 by a rotation force of the extracted water pump 120, and discharged through the discharge tube 730. A portion of the water discharge through the discharge tube 730 is discharged to outside of the washing machine, and the other portion of the water flows into the balance chamber 750 to fill the balance chamber 750 fully through the supply tube 740, and the inlet 751 to the balance chamber, and, therefrom to the supplementary tube 830 through an outlet 752 of the balance chamber. The water flowed into the supplementary tube 830 flows into the first drain tube 810 to fill the drain water flow passage 800 only up to an appropriate level by a difference of water levels caused by gravity. In order to prevent the water filled in the balance chamber 750 and the water filled to an appropriate level in the drain water flow passage 800 from flowing in a reverse direction to the reception tube 710, i.e., to the reception tube and the outer tub 11 to drain the water from the balance chamber, the check valve 920 provided to the connection part of the first drain tube 810 is closed automatically because a pressure in the reception tube 710 becomes lower than a pressure in the first drain tube 8 10 owing to the rotation force of the extracted water pump 120 in spinning, to push up the ball 923 until the hole 922 in the connection tube is closed. According to this, the water only flows to the reception tube 710. After the water is filled to an appropriate level of the drain water flow passage 800 by above operation, the water is then filled to the balance chamber 750 by the rotation force of the extracted water pump 120, which serves as the weight, a vibration attenuator in the related art, during spinning for attenuating the vibration.

Figure 11C:
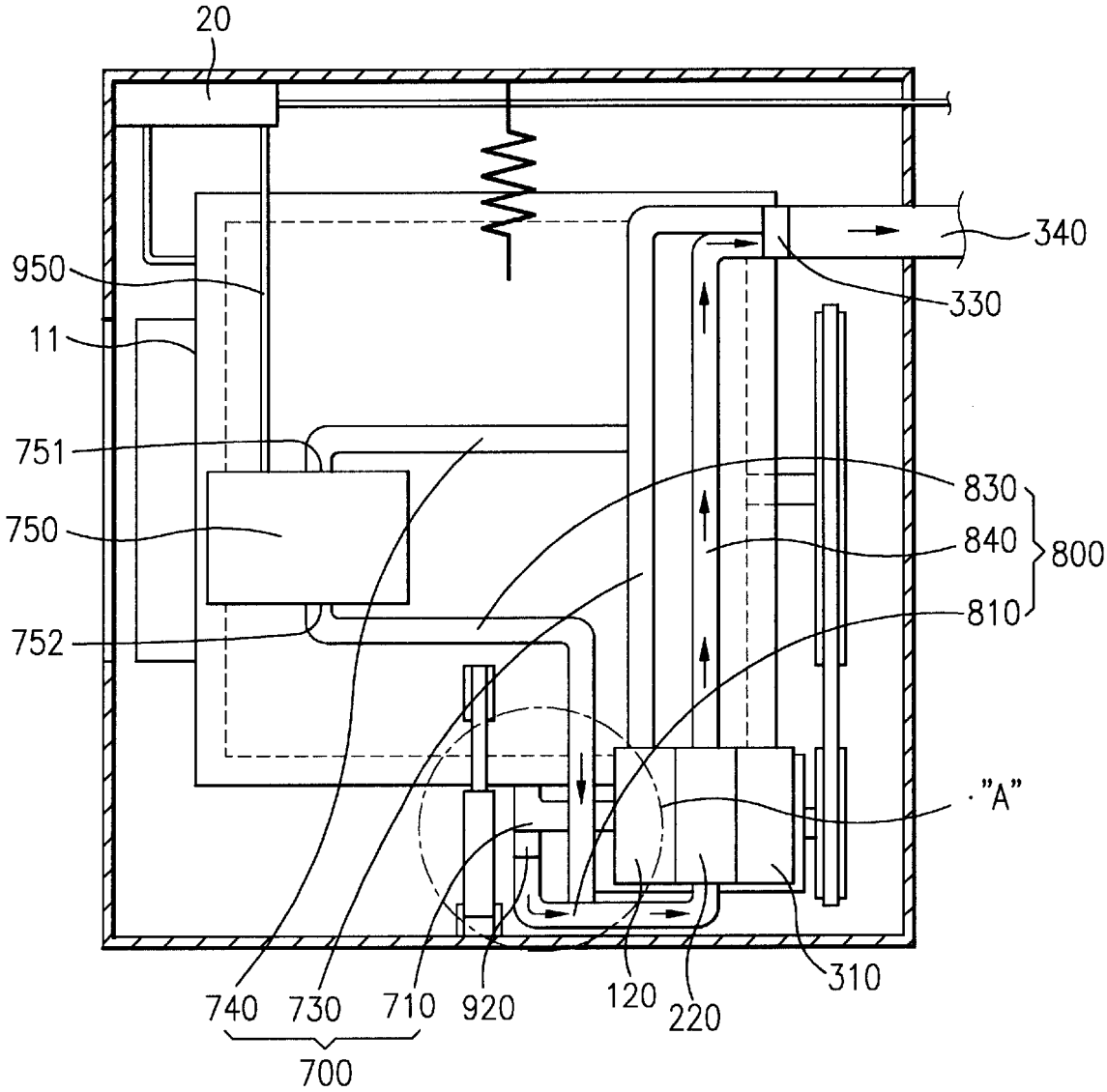
FIG. 11C illustrates water flow in draining in a device for attenuating vibration in accordance with a third preferred embodiment of the present invention, schematically.
Figure 11D:
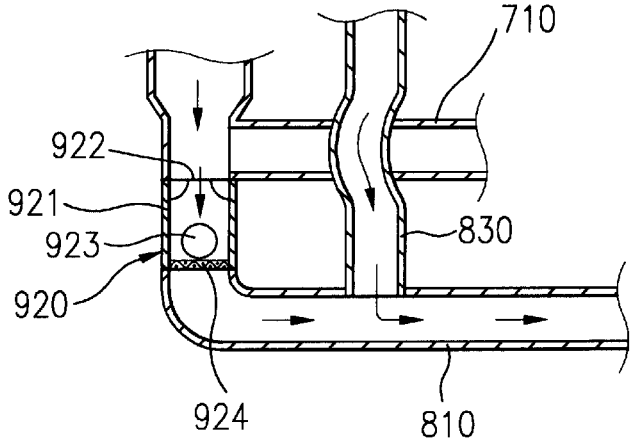
FIG. 11D illustrates a section of "A" part in FIG. 11C showing an operation state of one embodiment check valve in draining in a device for attenuating vibration in accordance with a third preferred embodiment of the present invention.

Second, referring to FIGS. 11C and 11D, the water stored in the balance chamber 750 flows to the first drain tube 810 through the supplementary tube 830 by the rotation force of the drain water pump 220. And, the water accumulated in, and to a level of the outer tub 11 also flows to the first drain tube from the reception tube 710 by the rotation force of the drain water pump. And, the water in the first drain tube 810 and in the drain water flow passage 800 is discharged to outside of the washing machine through the second drain tube 840 by a rotating force of the drain water pump 220, completely. A portion of the water in the outer tub 11 is drained as the check valve 920 is opened by a pressure difference between the first drain tube 810 and the reception tube 710 owing to the rotation force of the drain water pump 220, to drop the ball 923 from the hole 922 onto the support plate 924. Upon completion of draining according to the aforementioned operation, all operation of the device for attenuating vibration is finished.

Figure 11E:
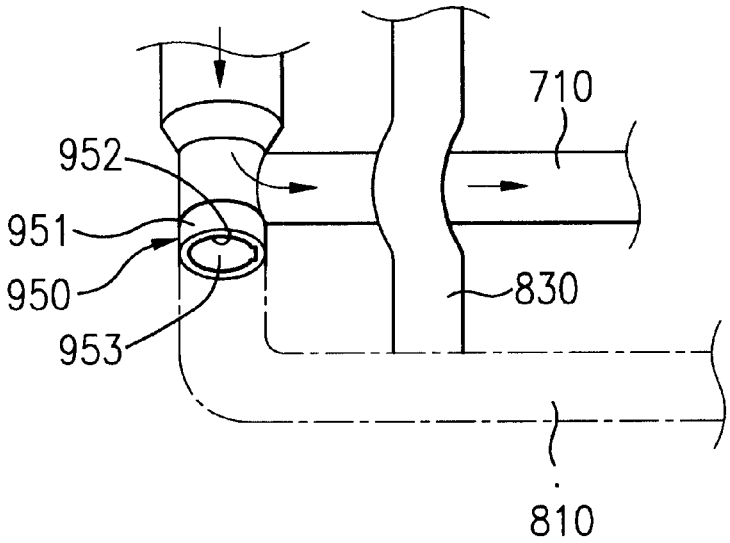
FIG. 11E illustrates a perspective view of a key part showing an operation state of another embodiment check valve in spinning in a device for attenuating vibration in accordance with a third preferred embodiment of the present invention; and, FIG. 11F illustrates a perspective view of a key part showing an operation state of a check valve in draining in a device for attenuating vibration in accordance with a third preferred embodiment of the present invention.
Figure 11F:
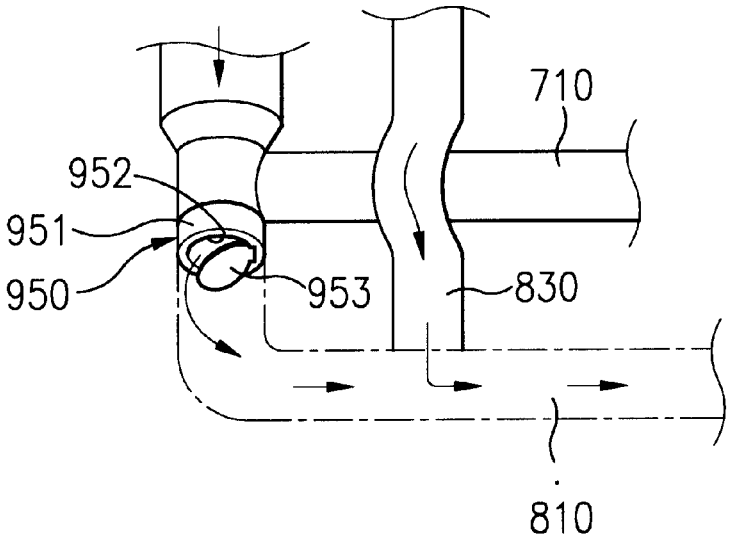

In the meantime, as shown in FIGS. 11E~11F, another embodiment of the check valve 950 has a connection tube 951 connected between the reception tube 710 and the first drain tube 810, a small hole 952 inside of the connection tube having a diameter smaller than a diameter of the connection tube centered on an axis of the connection tube formed by projection from a inside circumferential wall of the connection tube, and a stopper 953 fixed to the connection tube to allow swinging in the connection tube, for opening/closing the hole 952 by a pressure difference between the reception tube 710 and the first drain tube, to serve as a valve.

The operation of the check valve 950 in the device for attenuating vibration in accordance with the third preferred embodiment of the present invention will be explained in more detail for spinning and draining, separately.

First, as shown in FIG. 11E, because a pressure in the reception tube 710 becomes lower than a pressure in the first drain tube 810 owing to the rotation force of the extracted water pump 120 in spinning, the stopper 953 closes the hole 952 in the connection tube by a pressure difference. Accordingly, the water flows only to the reception tube 710.

Second, as shown in FIG. 11F, because a pressure in the first drain tube 810 becomes higher than a pressure in the reception tube 710 owing to the rotation force of the drain water pump 220, the stopper 953 moves away from the hole 952 by a pressure difference. Accordingly, the water flows to the first drain tube 810 through the hole.

Figure 10:
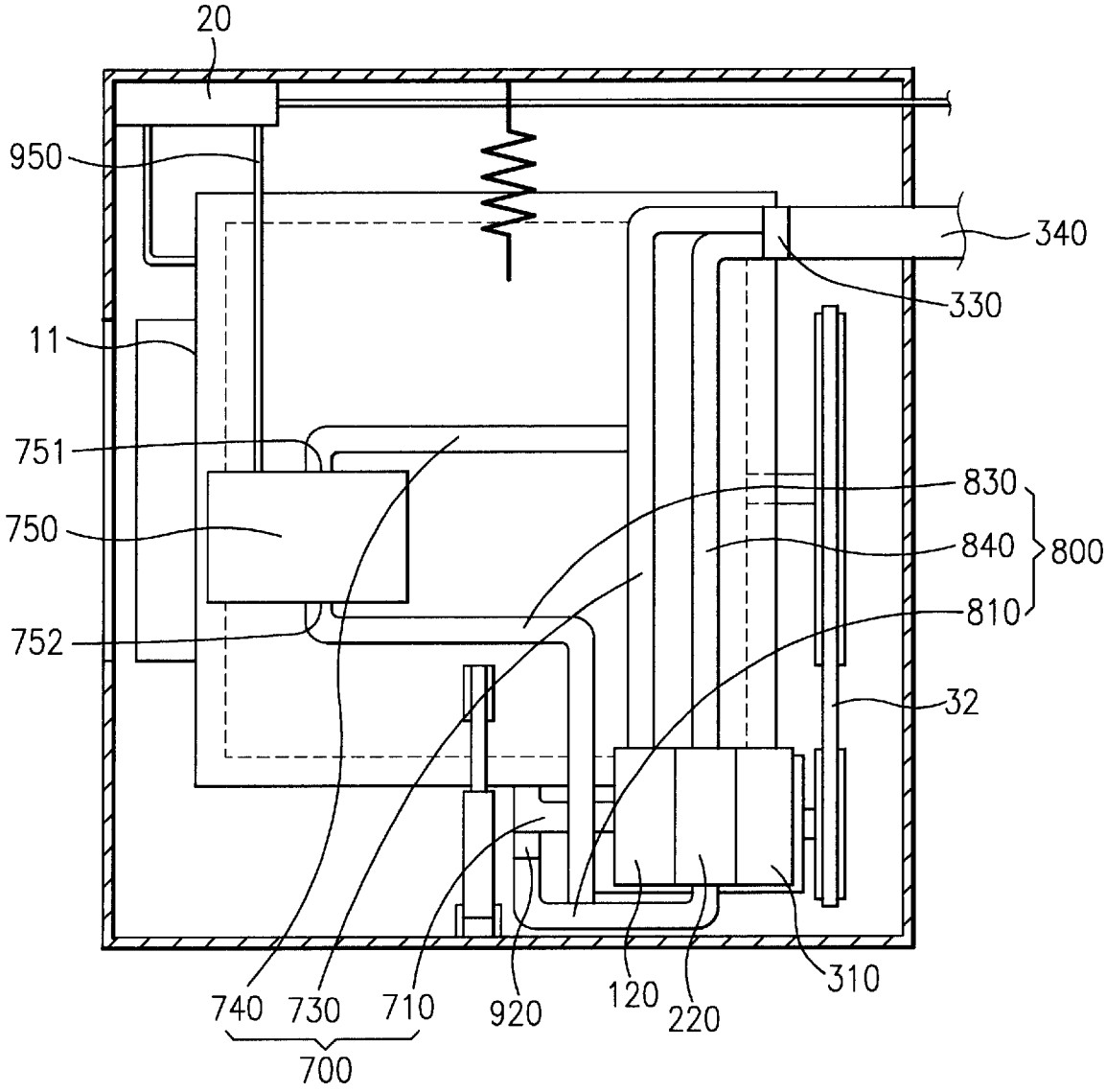
FIG. 10 illustrates a system of a device for attenuating vibration in accordance with a third preferred embodiment of the present invention.

In the meantime, as shown in FIGS. 10~11F, in order for the device for attenuating vibration in accordance with a third preferred embodiment of the present invention to be more desirable, it is preferable that the device for attenuating vibration has the additional components provided in the first embodiment, additionally.

First, the third embodiment device for attenuating vibration has a communication tube 950 having one end connected to a top of the balance chamber 750 and the other end connected to the water passage 20 through which the washing water provided additionally, for communication of air to/from the balance chamber for allowing smooth flow of the water to/from the balance chamber 750.

Second, the third embodiment device for attenuating vibration has a discharge hose 340 having one end connected both to an outer end of the discharge tube 730 and an outer end of the second drain tube 840, and the other end exposed to outside of the washing machine, additionally. Together with this, there is a supplementary check valve 330 provided at a connection of the discharge hose 340, the discharge tube 730 and the second drain tube 840.

Third, the third embodiment device for attenuating vibration has one pump motor shaft (see 312 in FIG. 6) having both the extracted water pump 120 and the drain pump 220 connected thereto, Fourth, the third embodiment device for attenuating vibration has a blocking wall(see 312 in FIG. 6) between the extracted water pump 120 and the drain water pump 220, additionally.

Detailed explanations on structures, services, and operations of the additional components will be omitted as they are explained in the first embodiment device for attenuating vibration.

In the meantime, in a method for controlling washing, a second form of the present invention for application of the device of the present invention, in which a washing cycle, a rinsing cycle, and a spinning cycle are carried out in succession, the spinning cycle has the step of supplying water to a balance chamber.

And, the method has a draining cycle for discharging water from the washing machine after the spinning cycle additionally, for full drainage of the water in the outer tub and the balance chamber after the spinning to achieve a light weighted washing machine.

As has been explained, the device for attenuating vibration of a drum type washing machine of the present invention has the following advantages.

The utilization of waste water as weight for attenuating vibration in spinning instead of the cast iron or concrete in the related art permits a significant saving in a component production cost.

The filling of the balance chamber only in spinning as the weight permits a light weighted washing machine for convenient transportation of the washing machine.

And, the elimination of reinforcement requirement for the weight permits additional savings in the production cost.

It will be apparent to those skilled in the art that various modifications and variations can be made in the device for attenuating vibration of a drum type washing machine of the present invention without departing from the spirit or scope of the invention. Thus, it is intended that the present invention cover the modifications and variations of this invention provided they come within the scope of the appended claims and their equivalents.

What is claimed is:

1. A device for attenuating vibration of a drum type washing machine comprising:

a balance chamber provided to an outer tub for temporary storage of extracted water in spinning for serving as a weight for attenuating vibration of the outer tub;

means for supplying the extracted water to the balance chamber in the spinning; and, means for draining the extracted water from the balance chamber to outside of the washing machine on completion of the spinning.

2. A device as claimed in claim 1, wherein the means for supplying the extracted water includes;

an extracted water flow passage for supplying water in the outer tub to the balance chamber on the same time with draining to outside of the washing machine, and an extracted water pump connected to the extracted water flow passage for pumping the extracted water for smooth drainage of the water.

3. A device as claimed in claim 2, wherein the extracted water flow passage includes;

a reception tube connected between a bottom of the outer tub and the extracted water pump for water flow from the outer tub to the extracted water pump, a supply tube connected between the extracted water pump and a bottom of the balance chamber, for supplying the water from the extracted water pump to the balance chamber, and a discharge tube having one end connected to a top of the balance chamber and the other end exposed to outside of the washing machine, for discharging surplus water after the balance chamber is filled fully to the outside of the washing machine.

4. A device as claimed in claim 3, wherein the drain water flow passage includes;

a first drain tube connected between one portion of the reception tube and the drain water pump for water flow from the outer tub and the balance chamber to the drain water pump, and a second drain tube having one end connected to the drain water pump and the other end exposed to outside of the washing machine for discharging water from the drain water pump to outside of the washing machine.

5. A device as claimed in claim 4, further comprising:

a discharge hose having one end connected both to an outer end of the discharge tube and an outer end of the second drain tube and the other end exposed to outside of the washing machine, for guiding the water both from the discharge tube and the second drain tube to one flow passage for discharging the water to outside of the washing machine; and, a supplementary check valve provided to a place where the discharge hose, the discharge tube, and the second drain tube are connected together for blocking reverse flow of the water from the discharge hose to the discharge tube or the second drain tube.

6. A device as claimed in claim 5, wherein the supplementary check valve includes;

a connector having a first hole for connection to the outer end of the discharge tube, a second hole for connection to the outer end of the second drain tube, and a hose connection hole in communication with the first and second holes for connection to the discharge hose, and a plug fitted to the connector so that only the first hole is swung opened in spinning and only the second hole is swung opened in draining by a pressure difference between the discharge tube and the second drain tube.

7. device as claimed in claim 3, further comprising a communication tube having one end connected to a top of the balance chamber and the other end connected to a water passage for receiving washing water in washing, for communication of air to the balance chamber.

8. A device as claimed in claim 3, further comprising a motor shaft having the extracted water pump and the drain water pump fitted thereto in common such that the extracted water pump is operative in spinning and the drain pump is operative in draining depending on direction of rotation of the motor.

9. A device as claimed in claim 8, further comprising a blocking wall for blocking flow of water between the extracted water pump and the drain water pump.

10. A device as claimed in claim 2, wherein the extracted water flow passage includes;

a reception tube connected between a bottom of the outer tub and the extracted water pump for flow of water from the outer tub to the extracted water pump, a discharge tube having one end connected to the extracted water pump and the other end exposed to outside of the washing machine for discharging water from the extracted water pump to outside of the washing machine, a supply tube having one end connected to a bottom of the balance chamber and the other end connected to a portion of the discharge tube lower than a bottom of the balance chamber for supplying a portion of the water discharged from the extracted water pump to the balance chamber, and a communication tube having one end connected to a top of the balance chamber and the other end connected to a water flow passage for flow of water in washing, for communication of air to the balance chamber.

11. A device as claimed in claim 10, wherein the drain water flow passage includes;

a first drain tube connected to a portion of the reception tube and the drain water pump for flow of water from the outer tub and the balance chamber to the drain water pump, and a second drain tube having one end connected to the drain water pump and the other end exposed to outside of the washing machine, for discharging water from the drain water pump to outside of the washing machine.

12. A device as claimed in claim 11, further comprising:

a discharge hose having one end connected both to an outer end of the discharge tube and an outer end of the second drain tube and the other end exposed to outside of the washing machine, for guiding water from the discharge tube and the second drain tube into one flow passage to discharge the water to outside of the washing machine; and, a supplementary check valve provided to a place where the discharge hose and the second drain tube are connected to the discharge hose, for blocking reverse flow of water from the discharge hose to the discharge tube or the second drain tube.

13. A device as claimed in claim 12, wherein the supplementary check valve includes;

a connector having a first hole for connection to the outer end of the discharge tube, a second hole for connection to the outer end of the second drain tube, and a hose connection hole in communication with the first and second holes for connection to the discharge hose, and a stopper fitted to the connector so that only the first hole is swung opened in spinning and only the second hole is swung opened in draining by a pressure difference between the discharge tube and the second drain tube.

14. A device as claimed in claim 10, further comprising a motor shaft having the extracted water pump and the drain water pump fitted thereto in common such that the extracted water pump is operative in spinning and the drain pump is operative in draining depending on direction of rotation of the motor.

15. A device as claimed in claim 14, further comprising a blocking wall for blocking flow of water between the extracted water pump and the drain water pump.

16. A device as claimed in claim 2, wherein the extracted water flow passage includes;

a reception tube connected between a bottom of the outer tub and the extracted water pump for flow of water from the outer tub to the extracted water pump, a discharge tube having one end connected to the extracted water pump and the other end exposed to outside of the washing machine for discharging water from the extracted water pump to outside of the washing machine, and a supply tube having one end connected to the discharge tube and the other end connected to a top of the balance chamber for supplying a portion of the water discharged from the extracted water pump to the balance chamber.

17. A device as claimed in claim 16, wherein the drain water flow passage includes;

a first drain tube connected to a portion of the reception tube and the drain water pump for flow of water from the outer tub and the balance chamber to the drain water pump, a supplementary tube connected between a bottom of the balance chamber and the first drain tube, for flow of water from the balance chamber to the drain water pump, a second drain tube having one end connected to the drain water pump and the other end exposed to outside of the washing machine, for discharging water from the drain water pump to outside of the washing machine, and a check valve provided to a connection part of the reception tube and the first drain tube for being opened/closed by a pressure difference between the reception tube and the first drain tube.

18. A device as claimed in claim 17, wherein the check valve includes;

a connection tube connected between the reception tube and the first drain tube, a small hole having a diameter smaller than a diameter of the connection tube centered on an axis of the connection tube formed by projection from an inside circumferential wall of the connection tube, a ball in the connection tube for opening/closing the hole by a pressure difference between the reception tube and the first drain tube to serve as a valve, and a support plate in the connection tube having a plurality of holes for supporting the ball during draining and allowing the water to pass.

19. A device as claimed in claim 17, wherein the check valve includes;

a connection tube connected between the reception tube and the first drain tube, a small hole having a diameter smaller than a diameter of the connection tube centered on an axis of the connection tube formed by projection from an inside circumferential wall of the connection tube, and a stopper provided to the connection tube to allow swinging in the connection tube, for opening/closing the hole by a pressure difference between the reception tube and the first drain tube, to serve as a valve.

20. A device as claimed in claim 17, further comprising:

a discharge hose connected both to an outer end of the discharge tube and an outer end of the second drain tube, for guiding water from the discharge tube and the second drain tube into one flow passage to discharge the water to outside of the washing machine; and, a supplementary check valve provided to a place where the discharge hose and the second drain tube are connected to the discharge hose, for blocking reverse flow of water from the discharge hose to the discharge tube or the second drain tube.

21. A device as claimed in claim 20, wherein the supplementary check valve includes;

a connector having a first hole for connection to the outer end of the discharge tube, a second hole for connection to the outer end of the second drain tube, and a hose connection hole in communication with the first and second holes for connection to the discharge hose, and a stopper fitted to the connector so that only the first hole is swung opened in spinning and only the second hole is swung opened in draining by a pressure difference between the discharge tube and the second drain tube.

22. A device as claimed in claim 16, further comprising a communication tube having one end connected to a top of the balance chamber and the other end connected to a water flow passage for flow of water in washing, for communication of air to the balance chamber.

23. A device as claimed in claim 16, further comprising a motor shaft having the extracted water pump and the drain water pump fitted thereto in common such that the extracted water pump is operative in spinning and the drain pump is operative in draining depending on direction of rotation of the motor.

24. A device as claimed in claim 23 further comprising a blocking wall for blocking flow of water between the extracted water pump and the drain water pump.

25. A device as claimed in claim 1, wherein the means for draining the extracted water includes;

a drain water flow passage for draining the water from the outer tub and the balance chamber to outside of the washing machine, and a drain water pump connected to the drain water flow passage for pumping the water for smooth drainage of the water.

* * * * *